US005405081A

United States Patent [19]

Bosshart

[11] Patent Number: 5,405,081

[45] Date of Patent: Apr. 11, 1995

[54] ANTI-ABRASION RAIL SEAT SYSTEM

[75] Inventor: John H. Bosshart, North Richland Hills, Tex.

[73] Assignee: Burlington Northern Railroad Company, Fort Worth, Tex.

[21] Appl. No.: 201,887

[22] Filed: Feb. 24, 1994

[51] Int. Cl.[6] ..... E01B 9/00

[52] U.S. Cl. ..... 238/283; 238/264

[58] Field of Search ..... 238/264, 283, 285, 306, 238/382

[56] References Cited

U.S. PATENT DOCUMENTS

| | | | |
|---|---|---|---|
| 801,278 | 10/1905 | Terwilleger . | |
| 1,045,741 | 11/1912 | Pinney . | |
| 1,058,435 | 4/1913 | Hyle . | |
| 2,337,497 | 12/1943 | Reddick | 238/283 |
| 2,996,256 | 8/1961 | Moses | 238/283 |
| 3,062,450 | 11/1962 | Hanff . | |
| 3,129,887 | 4/1964 | Meier . | |
| 3,223,328 | 12/1965 | Moses et al. | 238/382 |
| 3,826,424 | 7/1974 | McClung et al. . | |
| 3,831,842 | 8/1974 | Tamura | 238/283 |
| 3,904,112 | 9/1975 | Thim et al. . | |
| 4,925,094 | 5/1990 | Buekett . | |
| 5,110,046 | 5/1992 | Young . | |
| 5,173,222 | 12/1992 | Young et al. . | |

*Primary Examiner*—Mark T. Le
*Attorney, Agent, or Firm*—Robert A. Felsman

[57] ABSTRACT

A fluid impervious polymeric membrane separating a resilient pad from a railroad crosstie and having a width substantially greater than the resilient pad to resist moisture and mechanical forces in penetration between the concrete tie and the pad. The width is also sufficient to resist moisture penetration between the peripheral edges of the pad and the membrane. The width of the membrane is sufficient to extend essentially to the edge of the shoulder to limit lateral movement of the membrane caused by forces exerted by passing trains. Also, the membrane is substantially wider than the pad to extend essentially to the shoulder and insulator to resist lateral movement. Further, the pad is notched at a mid region adjacent to the insulator and clamp, with wider in regions, the notch resisting longitudinal movement of the membrane. The plastic material is selected from a group consisting of high density polyethylene, high molecular weight high density polyethylene and ultra high molecular weight polyethylene.

6 Claims, 4 Drawing Sheets

ANTI-ABRASION RAIL SEAT SYSTEM

BACKGROUND OF THE INVENTION

1. Field of the Invention

This invention relates to systems used to retard abrasion of concrete railroad tie rail seats and the resilient pads upon which they are seated.

2. Background Information

Railroads use concrete crossties and resilient pads upon which the rails are seated. There is a long-standing problem of abrasion of the resilient pads and the concrete tie rail seats that has perplexed experts in the railroad industry for years.

Analyses of this long-standing problem have revealed that resilient pads, typically composed of elastomeric material such as rubber, polyurethane, ethylvinylacetate or high density polyethylene, deflect vertically and horizontally in a cyclically fashion under the loads imposed by the wheels of passing trains. The cyclical loads imposed upon the pads create relatively short term vertical load pulses that cause the face of the pad to oscillate horizontally on the ties. The inevitable presence of sand particles and other contaminants creates an abrasive laden slurry when moisture is introduced to the interfaces of the pads and adjoining crossties. Consequently, the normally expected life span of 35 or more years for a concrete tie is often reduced by half or more. This slurry also contributes to premature failure of the resilient pads. This invention will reduce abrasion forces that were exerted from the concrete to the resilient pad.

A number of unsuccessful solutions to the problem of the abrasion or erosion of concrete tie rail seats and resilient pads have been proposed. One solution is proposed by John Buekett in U.S. Pat. No. 4,925,094. He proposes the use of stainless steel or other non-corrodible metal or plastic plates that are substantially the same width as the rail base used between each tie and the associated resilient pad. The plate is rectangular, for example, 3 mm thick, and cast into the top surface of the tie so that the top surface of the tie is flush with the surrounding surface of the tie. In order to cast the plates into the tie, they are located in the tie mold before filling it with concrete. Each plate has lugs projecting downwardly from its underside, which provides a mechanical connection with the concrete body of the tie. The plate is substantially the same width as the rail flange and extends substantially across the full width of the tie beneath the rail flange. Also, the plate has a stiffness less than that of the concrete tie and a smooth upper surface. The Buekett solution has not been accepted in the United States because of the additional expense of manufacture and because erosive wear can occur near the peripheral edges of the plate and the resilient pad.

Another proposed solution to combat the abrasive or erosive wear of concrete railroad ties is disclosed in U.S. Pat. No. 5,110,046 to Hartley F. Young. Young's proposed solution is the use of an abrasion resistant plate (that in actual delivered product is a spring steel plate) forming a slip plane to allow the resilient pad to slip in cyclical loading without wearing the surface of the concrete. There are two methods that Young discloses. One method is for previously worn concrete surfaces and one method for slightly worn and new surfaces. The thickness of the abrasion resistant plate is preferably 1 mm. Young states two forms of the adhering material are an adhesive such as an epoxy resin or an HDPE closed cell foam pad of 1.5 mm thickness of the same size and shape as the plate.

The worn concrete method involves using an epoxy to adhere the concrete and resilient steel pad and provides a smooth surface for the resilient pad to move back and forth on horizontally without wear to the concrete or resilient pad. This method also enables the restoration of the rail seat where the abrasive forces had forced the removal of the grout from the rail seat. Anytime there is a void under the steel plate there are forces placed on the plate which will eventually lead to fracturing of the plate.

The other suggested solution involves using a closed cell HDPE gasket 1.5 mm thick as "a layer of adhering material". The gasket does not adhere the abrasion resistant pad to the concrete. The light density HDPE gasket pushes into the concrete surface and provides a smoother surface to the concrete on which the steel plate rests. The abrasion resistant plate is very stiff and subject to cracking and therefore failure. When the plate fails, it also produces a sharp knife like edge under the rail that cuts and quickly destroys the resilient pad. While the steel plate appears to retard abrasive wear of a tie and pad, it moves against the clamp with the eventual formation of cracks in the resistant steel plate. This solution has not been accepted in the United States because the bond between the adhesive and the steel plate or the concrete fails and allows the abrasive slurry to penetrate voids between the pad and the concrete. Similarly, the closed cell foam material suffers from the same deficiency. The (spring steel) "abrasion resistant plate" is subject to cracking when any uneven material or surface is between the concrete and "abrasion resistant plate". Any point loading of a spring steel plate will cause eventual failure.

The solutions proposed above, as well as all other known solutions in the prior art, have not economically solved the long-standing problem of premature wear of concrete cross ties caused by abrasion, erosion or corrosion in the rail seats.

SUMMARY OF THE INVENTION

It is the general object of the invention to provide an anti-abrasion rail seat system that retards abrasive, erosive, or corrosive wear on lightly abraded or new railroad ties in an economical and advantageous manner.

According to the foregoing object, the invention is an anti-abrasion rail seat system that retards abrasive wear between a rail and a concrete tie to which rail flanges are secured by rail clips and insulators. An impervious polymeric membrane separates the resilient pad from the tie and has a width greater than the resilient pad to resist moisture penetration between the concrete tie and the pad. This membrane provides a flexible but extremely dense surface for the resilient pad to rest and move upon. This membrane protects the bottom of the resilient pad and prevents the concrete mortar, paste, and aggregate from wearing the resilient pad. The membrane also protects the concrete surface from the forces the resilient pad would have exerted on the concrete. The width is also sufficient to help resist moisture penetration between the peripheral edges of the pad and the membrane. The width of the membrane is sufficient to extend essentially to the edge of shoulder (post) to limit lateral movement of the membrane caused by forces exerted by passing trains. The plastic material is a moisture impervious polymeric membrane, preferably a high density polyethylene of ultra high molecular weight. Also, the membrane is substantially wider than the pad to extend essentially to the shoulder and insulator to resist lateral movement. Further, the pad is notched at a mid region adjacent to the insulator and clamp, with wider end regions, the notch resisting longitudinal movement of the membrane.

The above as well as additional objects, features and advantages of the invention will become apparent in the following detailed description.

DESCRIPTION OF THE PREFERRED EMBODIMENT

Figure 1:
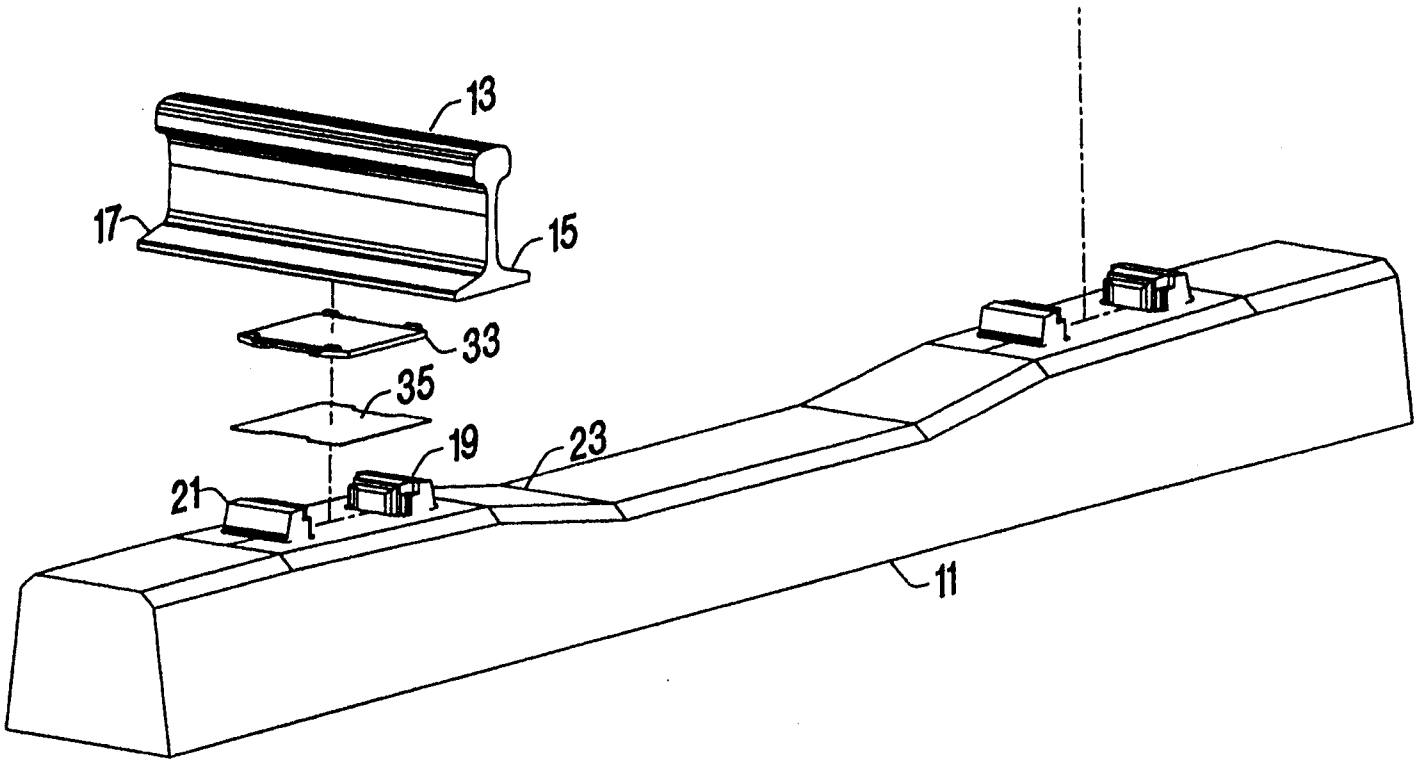
FIG. 1 is a perspective view of a crosstie, membrane, resilient pad and rail before assembly.

Referring initially to FIG. 1 of the drawing, the numeral 11 designates a crosstie upon which a rail 13 having base flanges 15, 17 is to be clamped, using shoulders 19, 21. The tie 11 is of the conventional configuration, including a mid-section 23 that is depressed.

Figure 2:
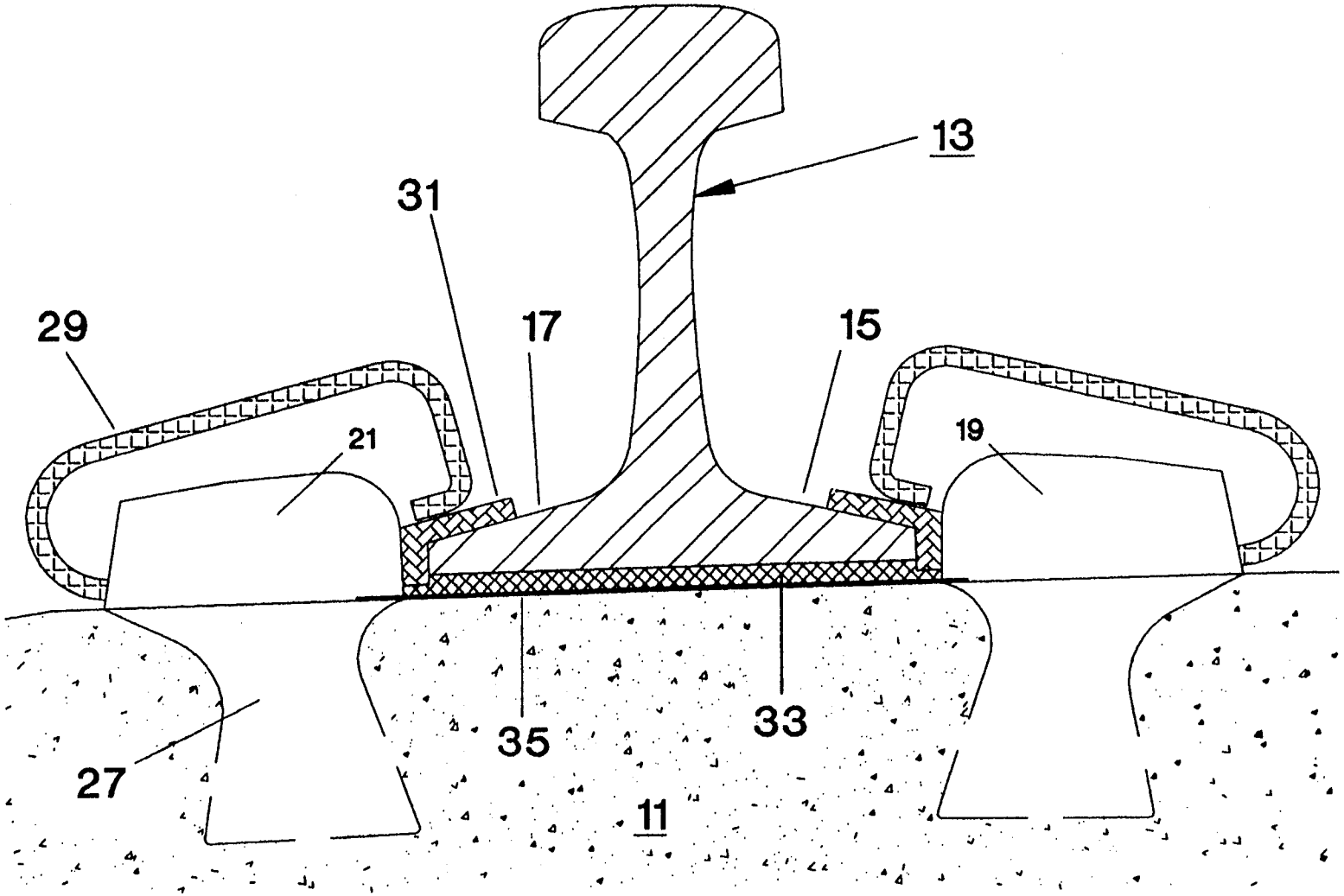
FIG. 2 is a cross-sectional view of a rail, membrane, pad and clamping assembly.

As shown in the cross-sectional view of FIG. 2, the base flanges 15, 17 of rail 13 are secured to the tie 11 by similar but oppositely facing clamp assemblies (or spring clips) 19, 21 that are of a type commonly used in the United States. Since they are identical, only one assembly will be described here. A shoulder 21 is anchored at 27 by being embedded in tie 11. A spring clip 29 engages and holds an insulator 31 against the base flange 17.

Beneath the rail 13 and its flanges 15, 17 is a resilient pad 33 having a width substantially equal to the distance across the shoulders, as shown in FIG. 2. The resilient pad is an elastomeric material such as rubber, polyurethane, ethylvinylacetate or a high density polyethylene. The term resilient pad is used broadly to encompass such materials and other material suitable for supporting and insulating a steel rail on a concrete tie.

Figure 3:
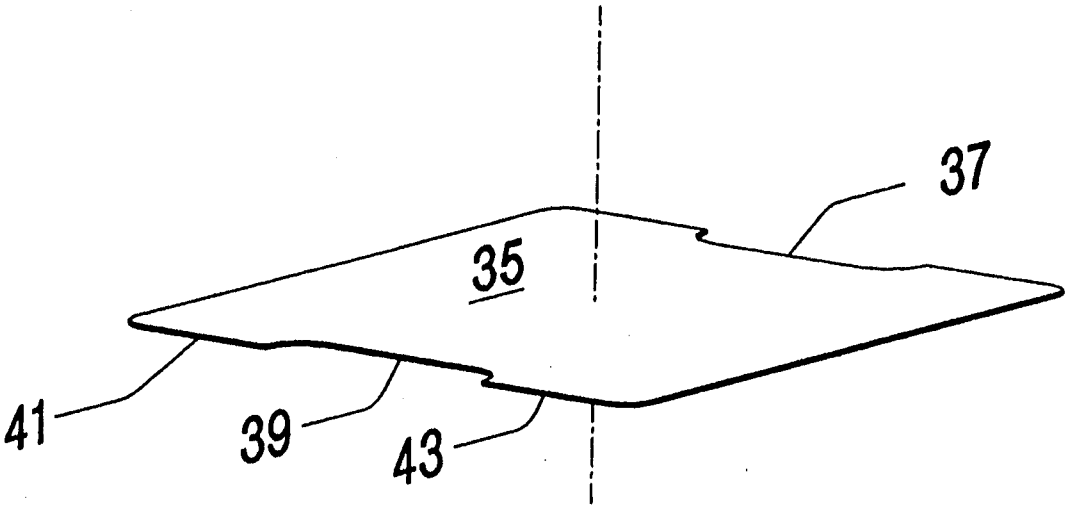
FIG. 3 is a perspective view of the membrane of FIGS. 1 and 2.

Beneath the resilient pad 33 is a polymeric, fluid impervious membrane 35 having a width greater than that of the resilient pad, as indicated in FIG. 2. It is selected from the group consisting of high density polyethylene, high molecular weight high density polyethylene and ultra high molecular weight polyethylene. Some references distinguish ultra high molecular weight (UHMW) polyethylene separately from high density polyethylene. The preferred membrane used in the invention is UHMW polyethylene. By definition, high density polyethylene (HDPE) has a density ranging from 0.941 to 0.965 g/cc. UHMW polyethylene may have a density which ranges from 0.935 to 0.957 g/cc and have a weight average molecular weight of 3 million or higher. Since the UHMW polyethylene has a density which ranges to a great extent between 0.941 to 0.965 g/cc, some would classify UHMW polyethylene as being a high density polyethylene. The high molecular weight (HMW) high density polyethylene has a density ranging from 0.944 to 0.954 g/cc and a weight average molecular weight of 200,000 to 500,000. As shown in FIG. 3, the membrane is notched at 37 and 39 to provide narrow mid regions adjacent the insulator and wider end regions 41,43 to resist longitudinal movement of the membrane relative to the insulator and post.

Figure 4:
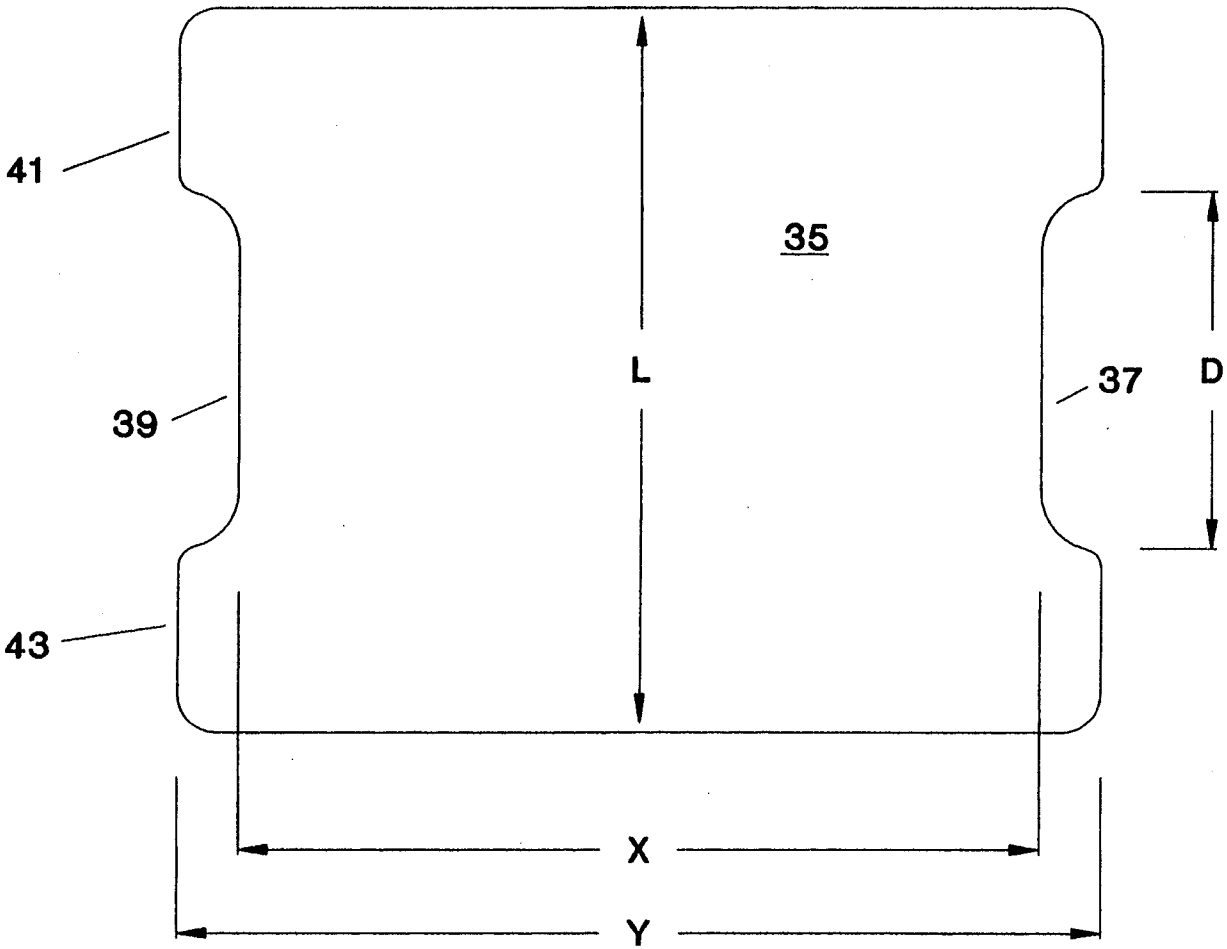
FIG. 4 is a plan view of the membrane of FIG. 3.

As shown in FIG. 4 as an example for 130–140 lbs/yd rail, the preferred distance X across the notched portion is about 166 mm, while the distance Y across each end region is approximately 191 mm for 6 inch (or 15.24 cm) base rail.

The distance D representing the length of the notches 37, 39 is approximately 75 mm, and the total length L is about 153 mm. The thickness of the membrane is preferably about 1 mm.

During installation, the notches 37, 39 of each membrane 35 are placed adjacent opposed shoulders 21 such that the larger end regions 41, 43 extend partially around the shoulder. When a train passes over the rail 13, cyclical compressions and expansion of the resilient pad 33 would induce fluid flow through the porous concrete tie 11 and to the interface between the pad and tie were it not for the intervention of the membrane 35. The pumping, vertical, and horizontal action caused by vertical and horizontal movements of the pad 33 is avoided by the impervious nature of the membrane 35 and its configuration.

There is evidence that the membrane moves during operation since large cyclical forces are imposed upon it by the resilient pad and rail upon the passing of trains and the repetitive loading of the wheels. On an uphill grade, the reaction between the rail and wheels causes a rearward movement of the rail and a rearward movement of the pad 33 and membrane 35. However, the notches 37, 39 of the membrane prevent it from moving excessively due to engagement with the insulators 35 or posts 19, 21. When the brakes of a train are applied on a downhill grade, the reaction between the wheels and rails causes a downward movement of the rail, pad and membrane 35. This downward movement is resisted by the notched configuration of the membrane. Curved track and passing trains tend to move the rails, pads and membrane laterally, but surprisingly, the membrane is not damaged by these lateral movements. The use of a metallic plate encountered severe problems, including the tendency of the plate to fracture. The steel plate also requires that the shoulder be clean of foreign debris such as grout that leaks onto the shoulders during the tie manufacturing process.

It should be apparent that I have provided an invention having significant advantages. The use of a free floating membrane of a thin polymeric material between the resilient pad and concrete tie is an economical solution to a long-standing and difficult problem. It is unnecessary to modify conventional ties in order to use the plastic membrane. It is unnecessary to take additional precautionary and expensive steps such as using an adhesive or other material between the membrane and a slightly worn rail seat or new concrete tie rail seat. Surprisingly, the relatively thin and relatively flexible polymeric membrane, when allowed to float between the resilient pad and tie and confined only by its exterior dimension, retards abrasive or erosive wear in an effective manner. If replacement of the membrane is required, the cost of replacement is low. Thus, I have provided a solution to the long-standing problem of abrasive or erosive wear of concrete ties and resilient pads in an economical and advantageous manner.

While I have shown my invention in only one of its forms, it will be apparent to those skilled in the art that it is susceptible to various modifications and changes.

I claim:

1. An anti-abrasion rail seat system to retard abrasion between a rail and a concrete tie, comprising:

a concrete tie to which a rail flange is secured by a pair of rail clips between a pair of opposed shoulders;

a resilient pad between the rail and the tie;

a fluid impervious polymeric membrane floating without attachment between and separating the resilient pad from the tie, with a width greater than the resilient pad to prevent moisture from reaching the pad around the edges of the membrane.

2. The invention defined by claim 1, wherein the membrane material is polyethylene.

3. The invention defined by claim 2, wherein the membrane material is selected from a group consisting of high density polyethylene, high molecular weight high density polyethylene and ultra high molecular weight polyethylene.

4. The invention of claim 1, wherein the membrane extends to a position adjacent the shoulders to limit movement of the membrane caused by the forces exerted by passing trains.

5. The invention of claims 1, 2, 3 or 4, wherein the membrane is about 1 mm thick.

6. The invention of claim 5, wherein the membrane is notched to provide a narrow mid-region adjacent the shoulder and wider end regions that cooperate to resist longitudinal as well as lateral movement of the membrane.

* * * * *